US005286015A

United States Patent [19]

Uzep

[11] Patent Number: 5,286,015

[45] Date of Patent: Feb. 15, 1994

[54] COMPUTER PAPER ASSEMBLY ORGANIZATION

[76] Inventor: Zena E. Uzep, 1 Bedford Dr., North Grafton, Mass. 01536

[21] Appl. No.: 905,468

[22] Filed: Jun. 29, 1992

[51] Int. Cl.[5] ..... B65H 39/00; B31F 5/00; G03D 15/04

[52] U.S. Cl. ..... 270/52; 156/157

[58] Field of Search ..... 156/157, 505, 506, 313, 156/502

[56] References Cited

U.S. PATENT DOCUMENTS 3,769,140 10/1973 Sayer ..... 156/502
3,776,795 12/1973 Stevenson ..... 156/157
4,056,426 11/1977 Sipin ..... 156/505
4,252,597 2/1981 Monroe ..... 156/505
4,289,556 9/1981 Booth ..... 156/506 X
4,390,389 6/1983 Bunas et al. ..... 156/505 X
4,487,645 12/1984 Weston ..... 156/157
4,501,630 2/1985 Kiuchi ..... 156/505 X
5,057,347 10/1991 Alvin ..... 156/157 X
5,106,358 4/1992 Meschi ..... 156/505 X

*Primary Examiner*—Richard A. Bertsch
*Assistant Examiner*—John Ryznic
*Attorney, Agent, or Firm*—Leon Gilden

[57] ABSTRACT

A support guide slidably mounts in a parallel relationship slide legs, with the slide legs each including a top surface having registration rods arranged for positioning first and second computer sheets together, with the organization to further include a joining web having an adhesive top surface oriented to underlie the first and second computer sheets to secure the computer sheets together to provide for a continuous paper flow.

1 Claim, 4 Drawing Sheets

COMPUTER PAPER ASSEMBLY ORGANIZATION

BACKGROUND OF THE INVENTION

1. Field of the Invention

The field of invention relates to computer paper structure, and more particularly pertains to a new and improved computer paper assembly organization wherein the same is arranged for the assembly of spaced computer sheets together.

2. Description of the Prior Art

In the use of computer paper, the computer paper is of an endless configuration, wherein typical computer printing devices are arranged to cooperate with the continuous type paper feed. The instant invention arranges for the joining of computer paper together by providing for the registration of spaced first and second sheets relative to one another utilizing an intermediate joining web. Various paper guides and the like are available in the prior art to accommodate paper flow, such as exemplified in U.S. Pat. Nos. 3,883,386; 4,417,517; 4,430,012; and 4,900,172.

Such paper flow structure is arranged for the smooth and continuous flow of paper relative to various structural devices, but heretofore the prior art has failed to address a need for a simple and convenient organization to secure separate computer sheets together as set forth by the instant invention and in this respect, the present invention substantially fulfills this need.

SUMMARY OF THE INVENTION

In view of the foregoing disadvantages inherent in the known types of computer paper apparatus now present in the prior art, the present invention provides a computer paper assembly organization wherein the same is arranged to secure first and second computer sheets together to form a continuous paper flow. As such, the general purpose of the present invention, which will be described subsequently in greater detail, is to provide a new and improved computer paper assembly organization which has all the advantages of the prior art computer paper apparatus and none of the disadvantages.

To attain this, the present invention provides a support guide slidably mounted in a parallel relationship to slide legs, with the slide legs each including a top surface having registration rods arranged for positioning first and second computer sheets together, with the organization to further include a joining web having an adhesive top surface oriented to underlie the first and second computer sheets to secure the computer sheets together to provide for a continuous paper flow.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved computer paper assembly organization which has all the advantages of the prior art computer paper apparatus and none of the disadvantages.

It is another object of the present invention to provide a new and improved computer paper assembly organization which may be easily and efficiently manufactured and marketed.

It is a further object of the present invention to provide a new and improved computer paper assembly organization which is of a durable and reliable construction.

An even further object of the present invention is to provide a new and improved computer paper assembly organization which is susceptible of a low cost of manufacture with regard to both materials and labor, and which accordingly is then susceptible of low prices of sale to the consuming public, thereby making such computer paper assembly organization economically available to the buying public.

Still yet another object of the present invention is to provide a new and improved computer paper assembly organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
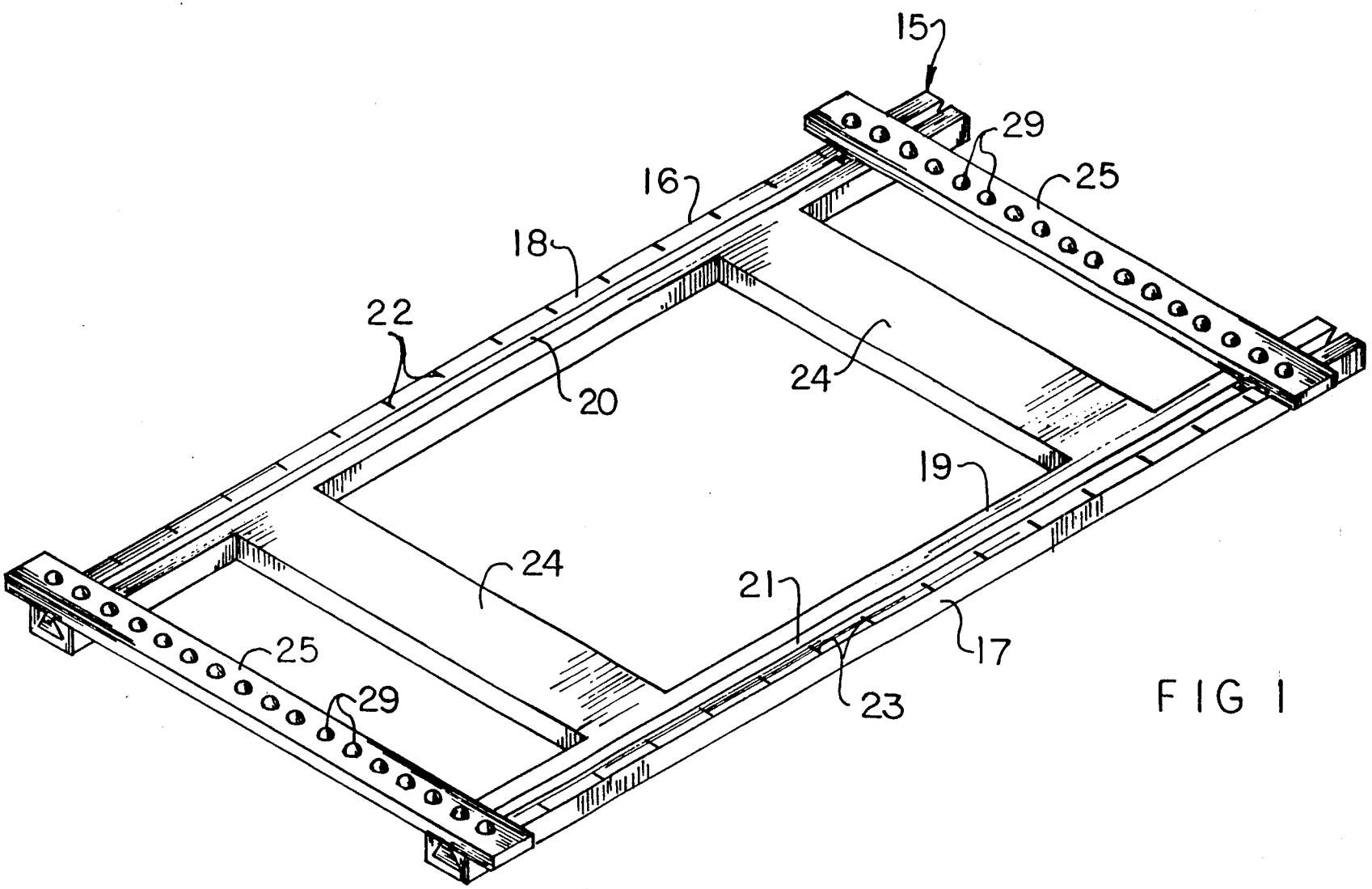
FIG. 1 is an isometric illustration of the support guide structure of the invention.
Figure 2:
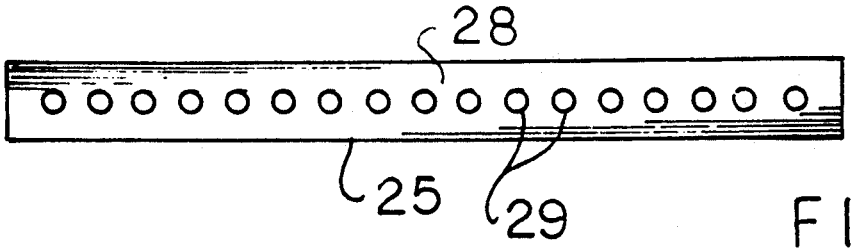
FIG. 2 is an orthographic top view of a slide leg member of the invention.
Figure 3:
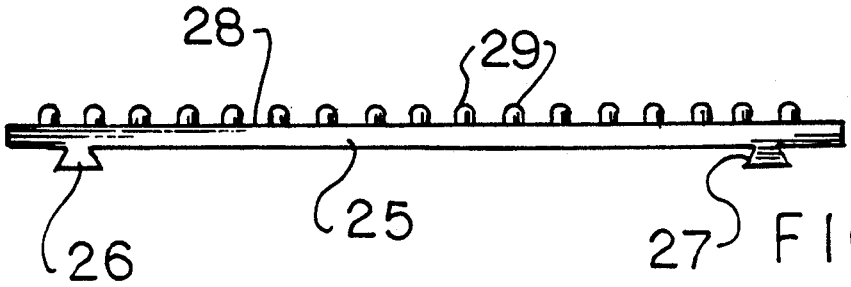
FIG. 3 is an orthographic side view of the slide leg as set forth in FIG. 2.
Figure 5:
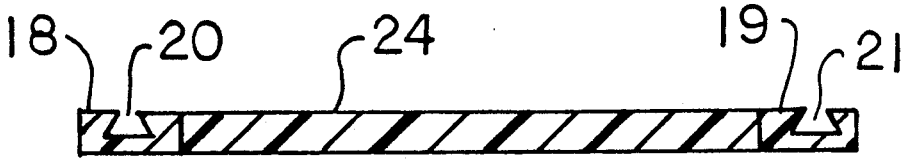
FIG. 5 is an orthographic view, taken along the lines 5—5 of FIG. 4 in the direction indicated by the arrows.
Figure 4:
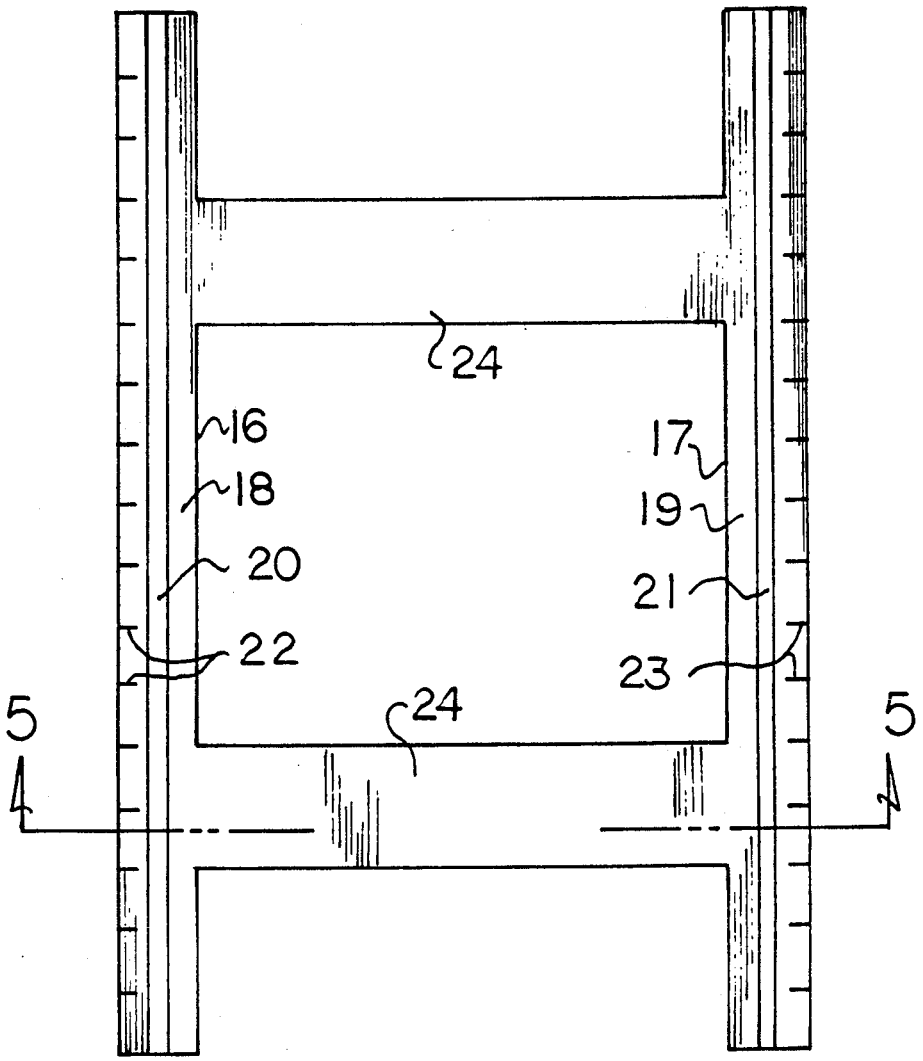
FIG. 4 is an orthographic top view of the support guide structure having the slide legs removed therefrom.
Figure 6:
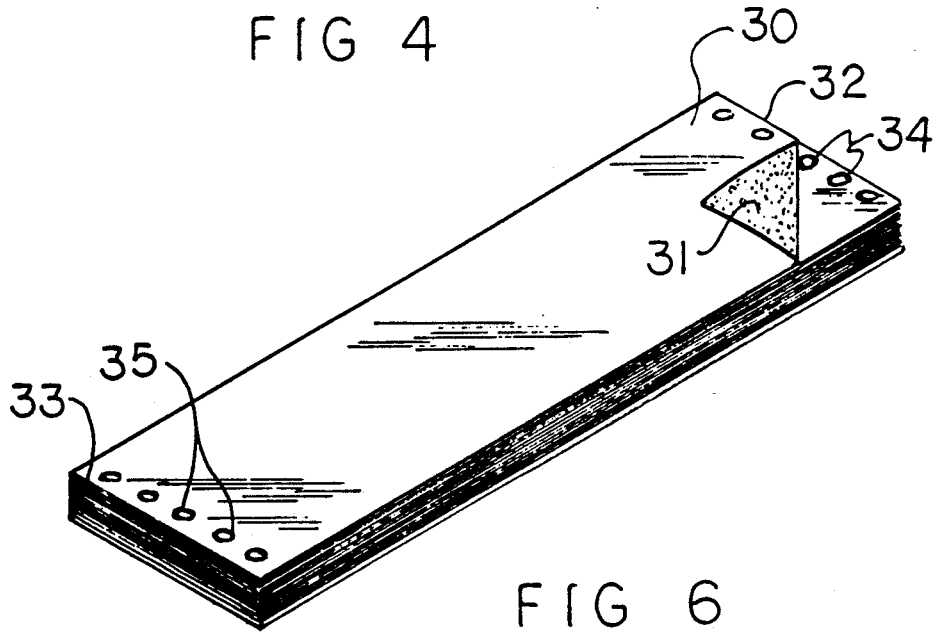
FIG. 6 is an isometric illustration of the joining webs utilized by the invention.

With reference now to the drawings, and in particular to FIGS. 1 to 7 thereof, a new and improved computer paper assembly organization embodying the principles and concepts of the present invention and generally designated by the reference numeral 10 will be described.

Figure 7:
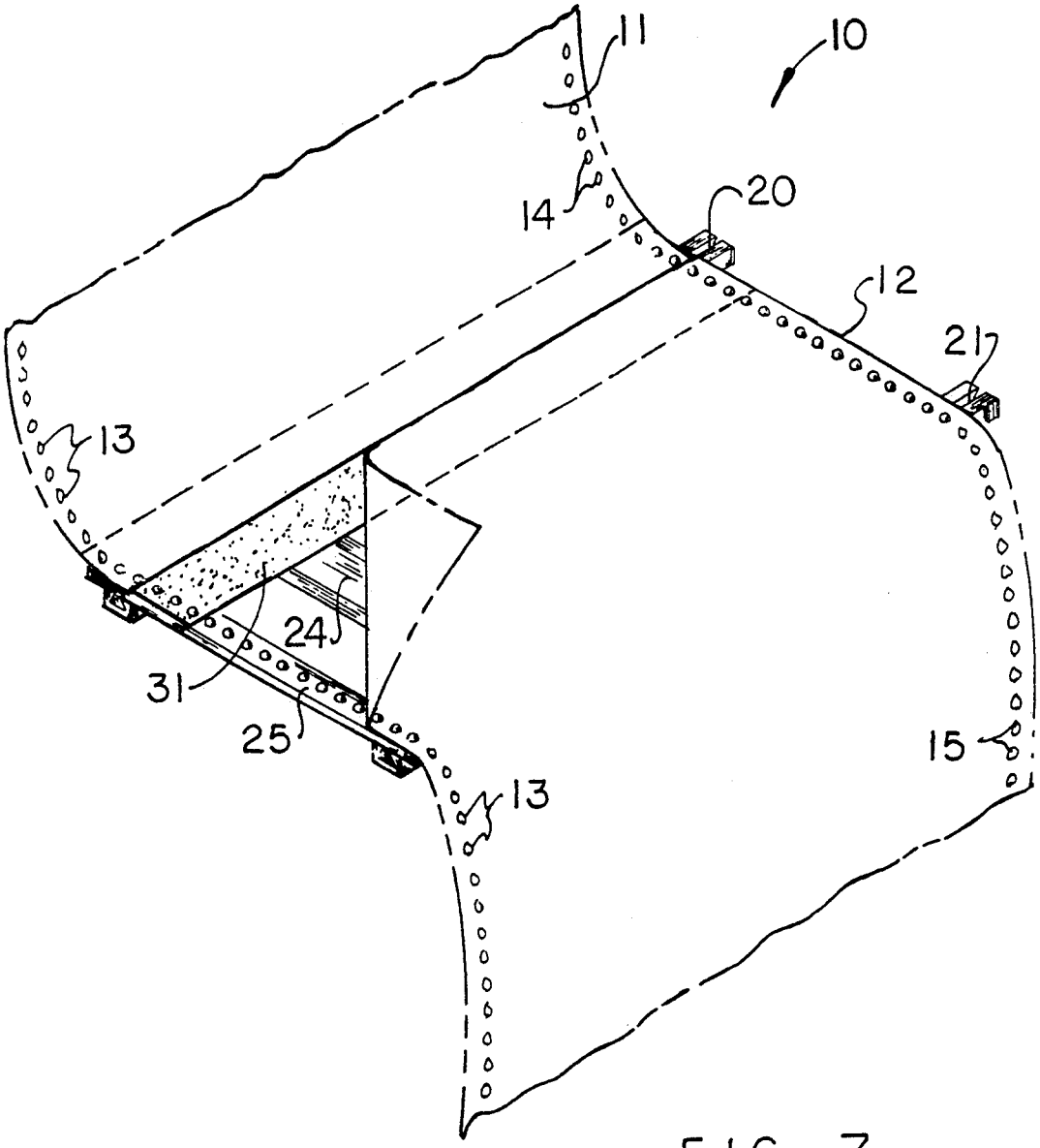
FIG. 7 is an isometric illustration of the organization in an assembled configuration cooperating with first and second computer sheets for their assembly.

More specifically, the computer paper assembly organization 10 of the instant invention essentially includes the assemblage of a first computer sheet 11 relative to a second computer sheet 12 in an end-to-end relationship, in a manner as illustrated in FIG. 7. The first and second computer sheets 11 and 12 each include respective first and second side apertures 13 and 14 spaced apart a predetermined spacing.

A support guide 15 (see FIG. 1) is provided having a first frame leg 16 arranged in a parallel and coextensive relationship relative to a second frame leg 17. The first frame leg 16 includes a first frame leg top wall having a first dovetail groove 20 directed therethrough. The second frame leg 17 in a like manner includes a second frame leg top wall 19 arranged in a coplanar relationship relative to the first frame leg top wall 18 and with the second frame leg top wall 19 including a second groove 21, with the first and second grooves arranged in a parallel and coextensive relationship relative to one another.

Respective first and second gradations 22 and 23 are directed along the first and second frame legs top walls 18 and 19 for accommodating computer paper of various widths.

At least one, and typically a plurality of, connection plates 24 are orthogonally directed between confronting sides of the first and second frame legs 16 and 17, with the connection plate 24 formed with a planar top surface coplanar with the first and second frame legs top walls 18 and 19. A plurality of slide legs 25 are provided arranged in a parallel relationship relative to one another and orthogonally oriented relative to the first and second frame legs 16 and 17. The slide legs 25 each include respective first and second dovetail projections 26 and 27 arranged for respective reception within the respective first and second dovetail grooves 20 and 21 to permit the slide legs 25 to slide in parallel relationship relative to one another. Each slide leg includes a slide leg top wall 28 having a plurality of registration rods 29 directed coextensively along the top wall 28, with the registration rods orthogonally mounted to the top wall and spaced apart the predetermined spacing of the first and second side apertures 13 and 14 to position those apertures within the registration rods, as indicated in FIG. 7, to permit alignment of the computer sheets 11 and 12 in an end-to-end relationship. Further, the organization includes a joining web 30 having an adhesive top surface 31 positioned to overlie the side legs top walls 28, and the connection plate 24. In use the adhesive top surface 31 is positioned upwardly under adjacent ends of the computer sheets 11 and 12, wherein as the computer sheets are positioned in a contiguous edge-to-edge relationship, the sheets are joined together when secured to the adhesive top surface 31 of a joining web 30. The joining web 30 is formed with joining web first and second sides 32 and 33 having respective first and second side apertures 34 and 35 spaced apart the predetermined spacing to provide for fixed registration of the joining web prior to its securement to the first and sheets 11 and 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A computer paper assembly method to join a plurality of computer sheets together, to include a first computer sheet and second computer sheet, and the first computer sheet and the second computer sheet each include a respective first side and a second side, with the first side of each of the computer sheets including a plurality of first side apertures spaced apart a predetermined spacing, and each of the second side of the first and second computer sheets includes a plurality of second side apertures spaced apart said predetermined spacing, the method further includes providing a support guide, wherein the support guide includes a first frame leg spaced from and parallel a second frame leg in a parallel and coextensive relationship, wherein the first frame leg and the second frame leg are provided to include a respective first top wall and a second top wall, with the first top wall including a first dovetail groove and the second top wall including a second dovetail groove, and the first dovetail groove and the second dovetail groove are spaced apart a predetermined distance, and providing a plurality of slide legs, wherein each of the slide legs includes a slide leg bottom wall and a slide leg top wall, with each slide leg bottom wall including a first dovetail projection slidably received within the first dovetail groove and a second dovetail projection slidably received in the second dovetail groove, and each slide leg top wall includes a plurality of registration rods spaced apart said predetermined spacing to accept said first computer sheet in a continuous coextensive edge-to-edge relationship with the second computer sheet, and the first computer sheet first side apertures are positioned and received on one of said slide legs and the second side apertures of the first and second computer sheets are positioned and received within a further of said plurality of slide legs, and the registration rods of the slide legs are received within the apertures, and providing a joining web, the joining web including an adhesive top surface, and the adhesive top surface is positioned coextensively below the first computer sheet and the second computer sheet to subsequently secure said first computer sheet and the second computer sheet onto the adhesive top surface, and the first frame leg and the second frame leg include at least one connecting plate fixedly and orthogonally extending between the first frame leg and the second frame leg to accept and receive the joining web on the connecting plate to minimize bowing of the first computer sheet and the second computer sheet when joining the first computer sheet and the second computer sheet together.

* * * * *